US005150804A

United States Patent [19]

Blanchet et al.

[11] Patent Number: 5,150,804

[45] Date of Patent: Sep. 29, 1992

[54] ROTATIONALLY RESISTIVE PAIL, PAIL SUPPORT AND COUPLING FOR CEMENTATIOUS OR VISCOUS MATERIALS

[76] Inventors: Oscar Blanchet, 12219-105 St., Edmonton AB, Canada T5G2N9; Donald Mills, 14518-31 St., Edmonton AB, Canada T5Y121

[21] Appl. No.: 669,676

[22] Filed: Mar. 14, 1991

[51] Int. Cl.[5] ..... B65D 51/00

[52] U.S. Cl. ..... 220/212; 220/379; 220/380; 206/505; 206/508; 206/509; 206/511; 206/512

[58] Field of Search ..... 220/380, 212, 379; 206/505, 509, 508, 511, 512; 215/10

[56] References Cited

U.S. PATENT DOCUMENTS

| | | | |
|---|---|---|---|
| 1,778,175 | 10/1930 | Thune . | |
| 2,564,834 | 8/1951 | Devine et al. | 206/505 |
| 2,567,322 | 9/1951 | Curtis . | |
| 3,079,037 | 2/1963 | Schechter . | |
| 3,515,306 | 6/1970 | Roper . | |
| 3,516,571 | 6/1970 | Roper . | |
| 3,606,074 | 9/1971 | Hayes . | |
| 4,311,238 | 1/1982 | Smith . | |
| 4,373,633 | 2/1983 | Lutz, Sr. | 206/509 X |
| 4,705,172 | 11/1987 | Gage | 220/308 X |
| 4,796,757 | 1/1989 | Strunkmann-Meister | 206/509 |
| 4,919,268 | 4/1990 | Young et al. | 206/509 |
| 4,981,214 | 1/1991 | Rojas | 206/509 X |

FOREIGN PATENT DOCUMENTS

| | | | |
|---|---|---|---|
| 2904478 | 8/1980 | Fed. Rep. of Germany | 215/10 |
| 259040 | 10/1926 | United Kingdom | 215/10 |

*Primary Examiner*—Stephen Marcus
*Assistant Examiner*—Paul A. Schwarz
*Attorney, Agent, or Firm*—Merchant, Gould, Smith, Edell, Welter & Schmidt

[57] ABSTRACT

In accordance with the preferred embodiment, the invention provides a rotationally resistive pail, pail support and coupling. The apparatus includes a pail, and a lid for closing the pail in a closing position, and for supporting the pail in a supporting and locking position. The pail has notches in the base of the pail. The lid has corresponding lugs for vertical interlocking and rotationally resistive engagement with the notches when the lid is in the supporting position. When the lid is in the supporting position, the lid supports the pail vertically and laterally, and the mating engagement of the lid and pail resists relative rotation between the lid and the pail.

10 Claims, 4 Drawing Sheets

ROTATIONALLY RESISTIVE PAIL, PAIL SUPPORT AND COUPLING FOR CEMENTATIOUS OR VISCOUS MATERIALS

FIELD OF THE INVENTION

This invention relates to the field of supports for containers, and more particularly to supports which may be coupled to pails, such as pails for containing premixed drywall cements and premixed and postmixed plasters, in addition to other viscous materials and which will serve to prevent lateral and rotational movement of the pail.

BACKGROUND OF THE INVENTION

In the gypsum drywall industry taping compounds are used, some of which must be mixed with potable water prior to application. In the plastering industry, pails of premixed plaster weighing in the order of 25 kg must be mixed with cement before being applied as a patching and finishing compound. In both industries, a portable mixer having mixing paddles which rotate at approximately 400–600 RPM is used to mix the cementatious or viscous materials. When the mixer is inserted into the cementatious or viscous materials in the pail, the pail tends to rotate with the mixer. To prevent this the installer must use his or her legs, feet or other means to rigidly hold the pail so as to prevent the pail from turning as the material is mixed. This is potentially dangerous, as mixing in this manner may cause injury or loss of balance to the worker because of the awkward position which he or she must assume to maintain control over the operation.

Various techniques and designs have been previously suggested for stacking and limiting movement of pails and similar containers.

U.S. Pat. No. 4,311,238, Smith, issued Jan. 19, 1982, teaches containers 11 and 11′ having bottom rims 16 and 16′, respectively. Containers 11 and 11′ may be stably stacked one on top of another by using closures 12. Closures 12 seal containers 11 and 11′. Closures 12 have lugs 41 which vertically and laterally support bottom rims 16 and 16′. Lugs 41 are circumferentially spaced protrusions, protruding inwardly from annular wall 33. Lugs 41 have upwardly opening, generally concavely curved surface segments 46 which substantially conform to the upwardly directed generally convexly contoured inner portion of bottom rims 16 and 16′. Bottom rims 16 and 16′ are circumferentially continuous around containers 11 and 11′.

Smith does not teach preventing rotation of containers 11 and 11′ when stacked on closures 12. Bottom rims 16 and 16′ are free to rotate on surface segments 46. Notching of bottom rims 16 and 16′ so as to engage lugs 41 is not taught due to the paperboard construction of containers 11 and 11′ which requires that bottom rims 16 and 16′ be left circumferentially continuous to retain the structural integrity of containers 11 and 11′.

U.S. Pat. No. 3,079,037, Schechter, issued Feb. 26, 1963, discloses, in one embodiment, open topped rectangular receptable 29 and tray-closure element 28. Tray-closure element 28 fits into the open top of receptable 29 so as to close receptacle 29. Tray-closure element 28 also fits onto the bottom of receptacle 29, and is held there by the engagement of bead 39 on receptacle 29 with groove 41 on tray-closure element 28.

Schechter does not suggest using tray-closure element 28 to prevent rotation of receptacle 29 relative to tray-closure element 28, although that is the effect of the rectangular embodiment of the container with tray-closure element 28 attached to its bottom surface. A rectangular embodiment is not, however, practically useful as a dry wall plaster pail, because mixing cannot be efficiently effected in the corners of the rectangular container. Thus, rectangular containers cause waste, as the unmixed plaster is unusable, and further introduce the chance of inferior dry walling, in that unmixed plaster might be inadvertently employed along with mixed plaster. The round embodiments of the container and tray-closure element do not act to prevent rotation of the container relative to the tray-closure element when the tray-closure element is attached to the bottom of the container because bead 16 is free to rotate within groove 27.

SUMMARY OF THE INVENTION

The present invention comprises a rotationally resistive pail, pail support and coupling. The apparatus includes a pail, and a lid for closing the pail in a closing position, and for supporting the pail in a supporting and locking position. The pail has a lid engaging means in the base of the pail. The lid has a pail engaging means for vertical interlocking and rotationally resistive engagement with the lid engaging means when the lid is in the supporting position. When the lid is in the supporting position, the lid supports the pail vertically and laterally, and the mating engaging elements of lid and pail resist relative rotation between the lid and the pail.

In one embodiment, the lid engaging means comprise notches in the base of the pail, and the pail engaging means comprises corresponding lugs protruding from the rim of the lid. In a further embodiment, the pail has a notched rim which extends downwards from the base of the pail, and the lid has a raised circumferential rim from which lugs corresponding to the notches protrude. The notched rim fits snugly within the raised circumferential rim so that, with the lugs engaging the corresponding notches, the base of the pail is not only prevented from rotating relative to the lid, but is also supported laterally by the lid so as to prevent sideways or fore and aft motion of the pail on the scaffold or supporting floor while the plaster is being mixed.

In operation, the lid is removed from the pail and affixed to an immovable surface, with the side of the lid having the lugs facing upwards. The pail is then set down on top of the lid so that the notches in the base of the pail engage the corresponding lugs on the lid. The pail may then be used with out fear of the pail rotating and without the necessity of having other bracing applied to the pail to prevent sideways motion of the pail on the scaffold or supporting floor.

DETAILED DESCRIPTION OF THE PREFERRED EMBODIMENT

Figure 1:
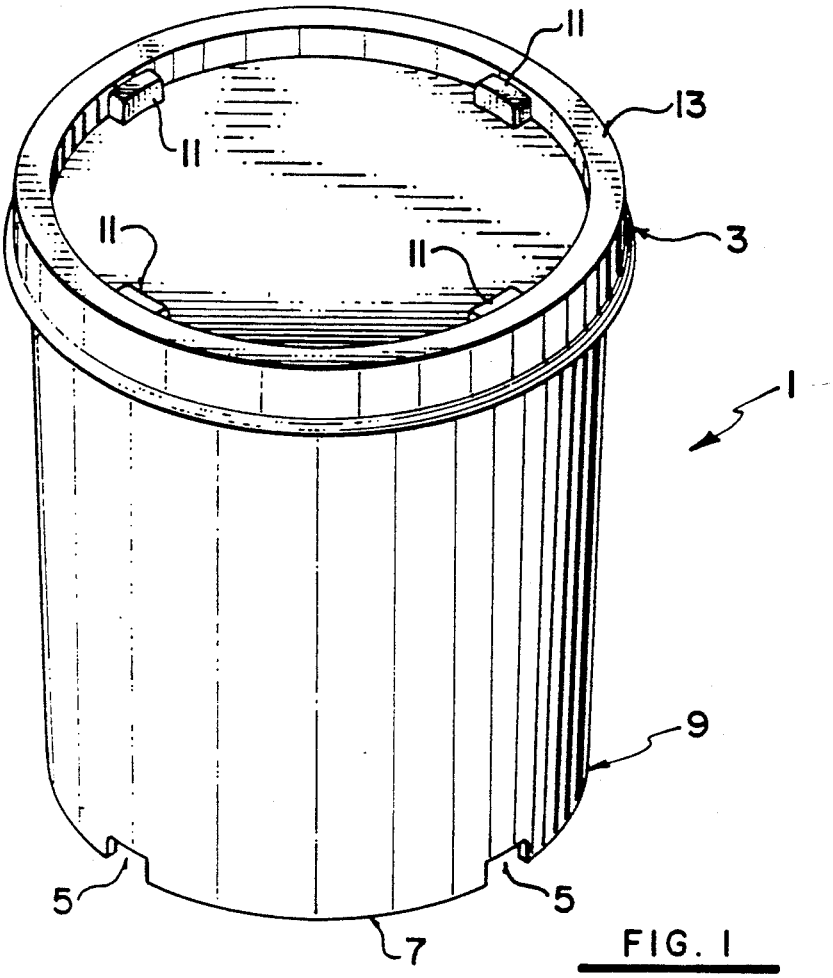
FIG. 1 is an isometric view of a preferred embodiment of the invention showing the lid on the pail.

Referring now to the drawings, and in particular to FIG. 1, pail 1 is closed by lid 3. Pail 1 may be of a conventional plastic variety and, preferably, has a round horizontal cross-section. Pail gently tapers downwards towards its base 9. A circumferential base rim 7 extends substantially vertically downwards from base 9. Rim 7 has notches 5 spaced around its circumference. Resealable mating plastic lid 3 has lugs 11 protruding inwardly from, and spaced around, raised circumferential lid rim 13 on the upper surface of lid 3.

Figure 2:
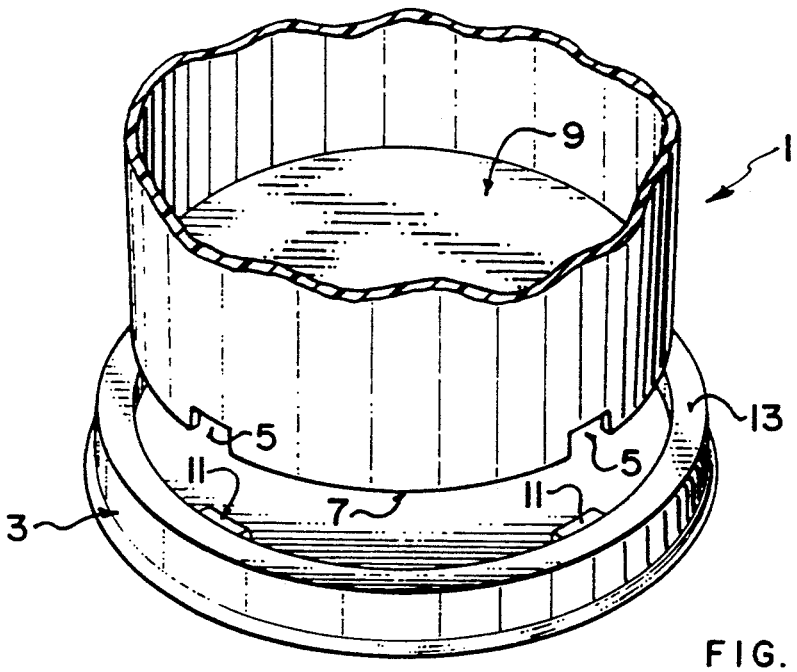
FIG. 2 is an isometric partial view of the embodiment of FIG. 1, showing the base of the pail aligned to engage the lid of the pail.

FIG. 2 illustrates lid 3 in a pail supporting/interlocking position. Pail 1 is being lowered onto lid 3 so that notches 5 engage mating lugs 11. Rim 7 fits snugly within lid rim 13 so that, with lugs 11 engaging corresponding notches 5, pail 1 is prevented from rotating about its longitudinal axis relative to lid 3, and is supported laterally on lid 3 by lid rim 13 so as to prevent sideways or fore and aft motion of pail 1 on immovable surface 17 (see FIG. 4).

Figure 3:
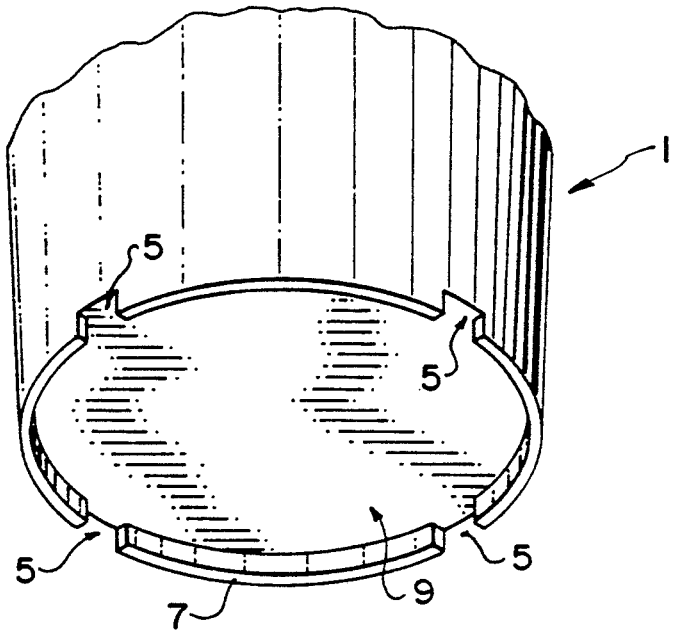
FIG. 3 is an isometric partial view of the base of the pail of FIG. 1.

FIG. 3 illustrates the underside of pail 1, showing base 9, rim 7 and notches 5.

Figure 4:
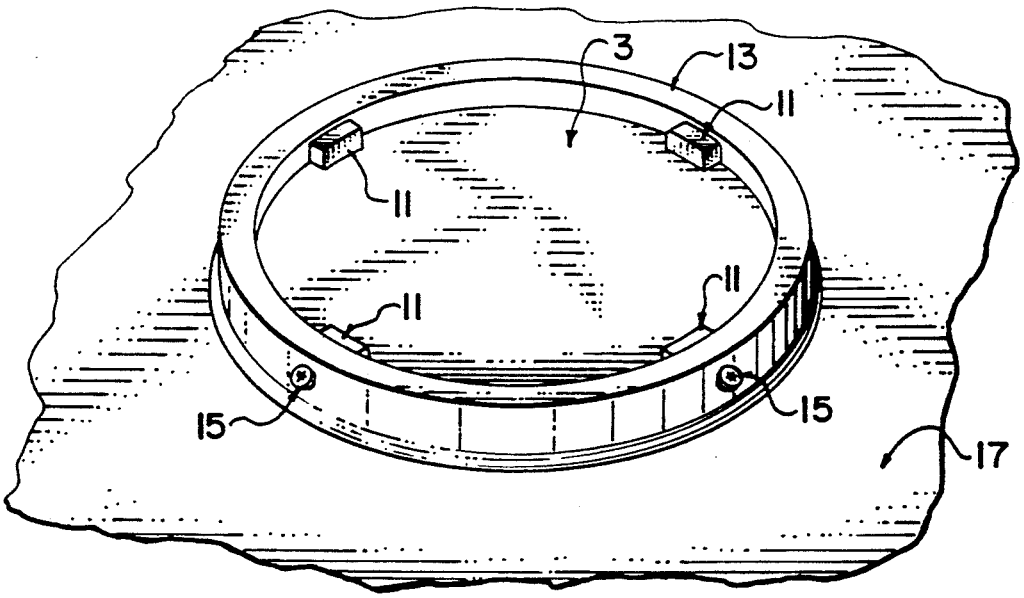
FIG. 4 is an isometric view of the lid of FIG. 1 rigidly affixed to a supporting surface.

In operation, lid 3 is removed from pail 1 and affixed, as shown in FIG. 4, by screws or nails 15 to immovable surface 17, where immovable surface 17 might be wooden scaffolding or the like. Lid 3 is affixed to immovable surface 17 so that lugs 11 face upwards. Pail 1 is then set down onto lid 3 so that notches 5 in rim 7 engage corresponding lugs 11 on lid 3.

Figure 5:
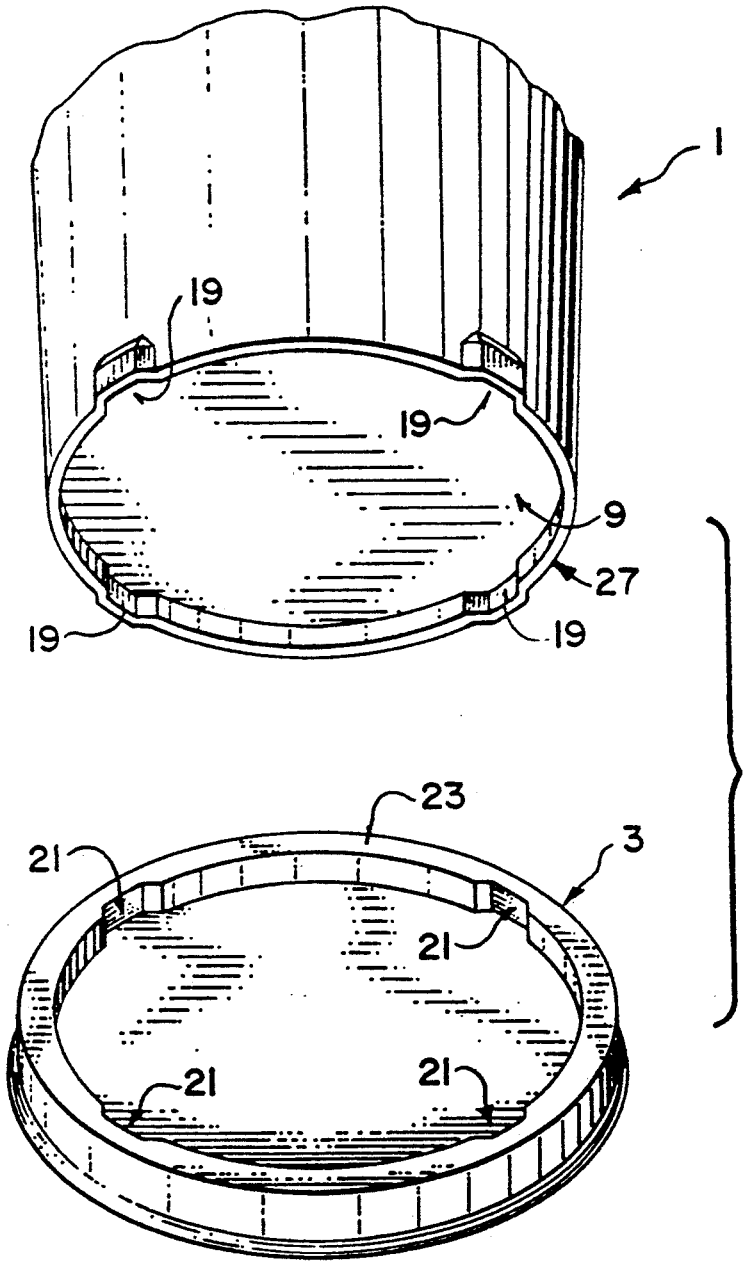
FIG. 5 is an isometric partial view of a further embodiment of the invention showing the base of the pail aligned to engage the lid of the pail.

FIG. 5 illustrates a further embodiment of the invention. Pail 1 has pail lugs 19 protruding from the circumferential base rim 27 for locking vertical engagement with corresponding lid notches 21 on lid rim 23. Lid rim 23 surrounds base 9 when pail lugs 19 are lockingly engaged in lid notches 21.

Figure 6:
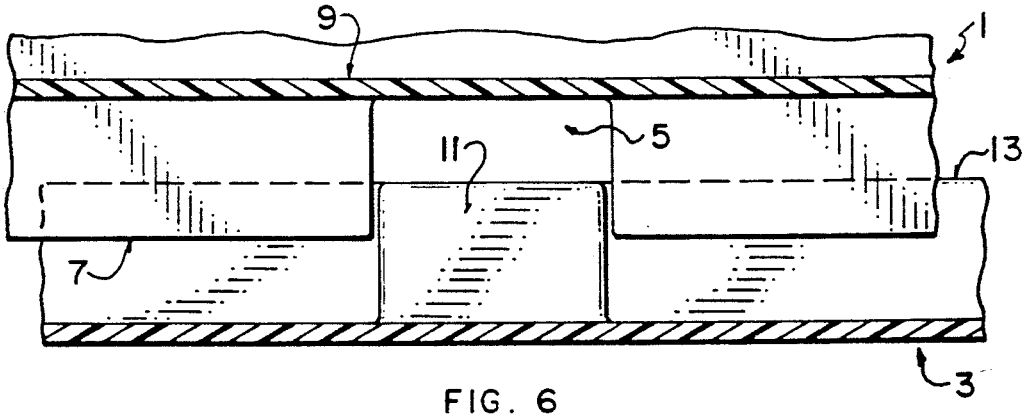
FIG. 6 is a partial side elevation view of a preferred embodiment of the invention showing the base of the pail aligned to engage the lid of the pail.
Figure 7:
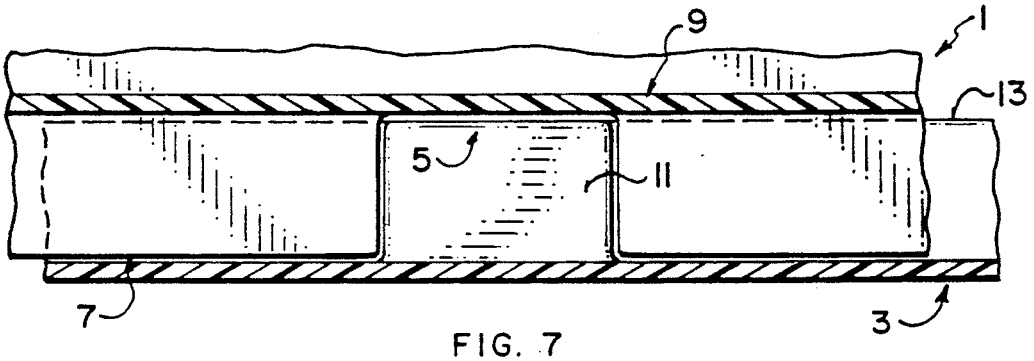
FIG. 7 is a partial side elevation view of a preferred embodiment of the invention showing the base of the pail engaging the lid of the pail.

FIGS. 6 and 7 illustrate the alignment and engagement, respectively, of base 9 with lid 13 by the alignment and engagement of lugs 11 with notches 5.

Figure 8:
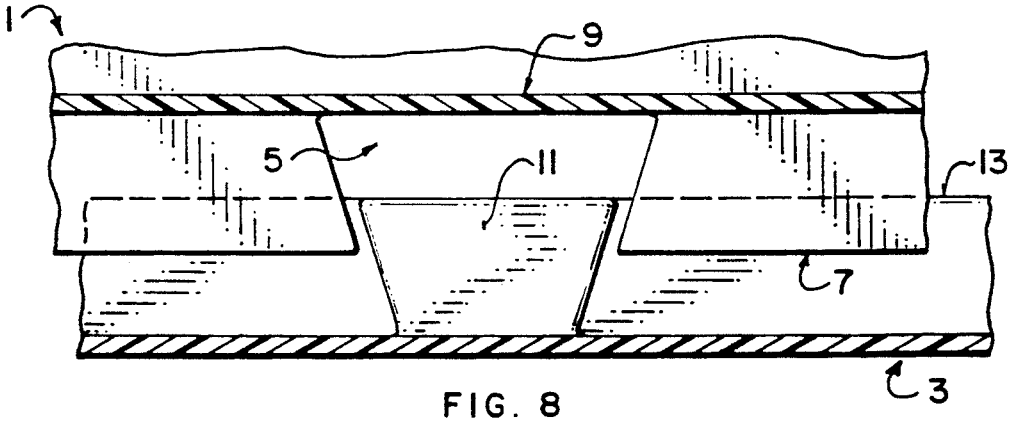
FIG. 8 is a partial side elevation view of an alternative embodiment of the invention showing the base of the pail aligned to engage the lid of the pail.
Figure 9:
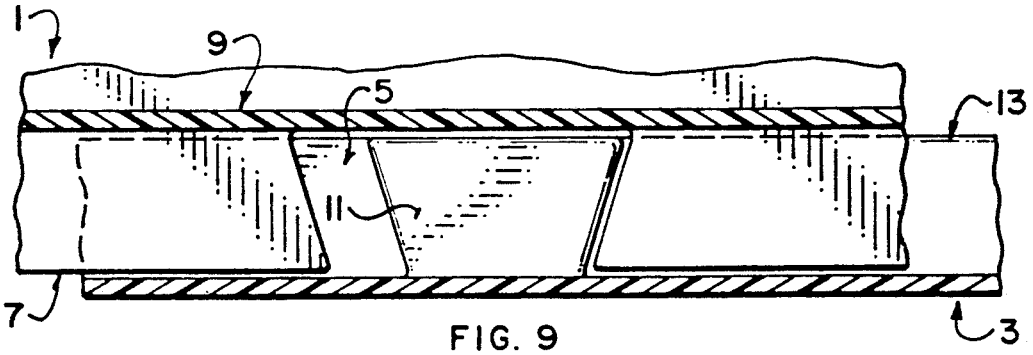
FIG. 9 is a partial side elevation view of an alternative embodiment of the invention showing the base of the pail engaging the lid of the paid.

FIGS. 8 and 9 illustrate the alignment and engagement, respectively, of an alternative embodiment of lugs 11 with notches 5. Lugs 11′ on lid 3 are aligned with notches 5′ in notched rim 7 so that lugs 11′ engage corresponding notches 5′ when pail 1 is set down onto lid 3.

Notches 5′ have sides which, within the wall of pail 1, slope outwardly and upwardly from the bottom surface of rim 7, and lugs 11′ have corresponding outwardly and upwardly shaped sides for vertically locking engagement with notches 5′. Notches 5′ and corresponding lugs 11′ are in the general shape of a trapezoid. In this configuration pail 1 is urged downward onto lid 3 by initial rotational motion of pail 1 relative to lid 3 once notches 5′ initially engage lugs 11. The lower edges of notches 5 fit over the upper edges of lugs 11′. Once pail 1 has initially rotated, and one of the sloped sides of notches 5′ have engaged the correspondingly sloped sides of lugs 11′, vertical movement of pail 1 relative to lid 3 is restricted.

As will be apparent to those skilled in the art in the light of the foregoing disclosure, many alterations and modifications are possible in the practice of this invention without departing from the spirit or scope thereof. For example, the number, shape and size of the notches and mating lugs could be varied. Accordingly, the scope of the invention is to be construed in accordance with the substance defined by the following claims.

What is claimed is:

1. A rotationally resistive pail, pail support and coupling, comprising:

a hollow pail having an opening and a base;

said pail having a lid engaging means in said base of said pail; and, a mating lid for said pail, separate from said pail for disengageable closure of said pail opening, and for removal from said disengageable closure of said pail opening and placement so as to be releasably engageable with said pail base for supporting and lockingly engaging said pail in a supporting position;

said lid having a pail engaging means for vertical interlocking and rotationally preventative engagement with said lid engaging means when said lid is in said supporting position, wherein:

(a) when said lid is in said supporting position, said lid supports said pail vertically, and said engaging means prevents forced relative rotation between said lid and said pail;

(b) said base of said pail includes a circumferential base rim depending from said pail, and said lid engaging means is at least one notch in said base rim; and (c) said lid includes a circumferential lid rim circumscribing said lid, and said pail engaging means is at least one lug protruding from said lid rim for mating with said notch.

2. The device of claim 1, wherein said lid rim surrounds said base rim when said lid is in said supporting position.

3. The device of claim 2 wherein said at least one notch and said at least one lug have corresponding side surfaces which, when said lid is supporting said pail, slope upwardly and outwardly from a lower surface of said circumferential base rim so as to vertically releasably lockingly engage said pail to said lid.

4. The device of claim 1 wherein said lug extends radially through said notch.

5. The device of claim 1 wherein said lug extends in a direction radial to said lid and said pail, and said lug has sides which are substantially vertical.

6. A rotationally resistive pail, pail support and coupling, comprising:

a hollow pail having an opening and a base;

said pail having a lid engaging means in said base of said pail; and, a mating lid for said pail, separate from said pail for disengageable closure of said pail opening, and for removal from said disengageable closure of said pail opening and placement so as to be releasably engageable with said pail base for supporting and lockingly engaging said pail in a supporting position;

said lid having a pail engaging means for vertical interlocking and rotationally preventative engagement with said lid engaging means when said lid is in said supporting position, wherein:

(a) when said lid is in said supporting position, said lid supports said pail vertically, and said engaging means prevents forced relative rotation between said lid and said pail;

(b) said base of said pail includes a circumferential base rim depending from said pail, and said lid engaging means is at least one lug protruding from said base rim; and (c) said lid includes a circumferential lid rim circumscribing said lid, and said pail engaging means is at least one notch in said lid rim adapted to mate with said lug.

7. The device of claim 6, wherein said lid rim surrounds said base rim when said lid is in said supporting position.

8. A rotationally resistive pail, pail support and coupling, comprising:

a hollow pail having an opening and a base;

said pail having a lid engaging means in said base of said pail;

a mating lid for said pail separate from said pail, for disengageable closure of said pail opening, and for removal from said disengageable closure of said pail opening and placement so as to be releasably engageable with said pail base for supporting and lockingly engaging said pail in a supporting position;

said lid having a pail engaging means for vertical interlocking and rotationally resistive engagement with said lid engaging means when said lid is in said supporting position, said pail engaging means comprising at least one lug and said lid engaging means comprising at least one notch corresponding to said lug wherein said lug comprises a substantially trapezoidal element and said notch has a correspondingly shaped opening when viewed in a direction radial to said lid and said pail, for vertical interlocking engagement with said element, wherein said substantially trapezoidal element has a top and bottom, and said top is at least as wide as said bottom when viewed from a direction radial to said lid and said pail, and wherein, when said lid is in said supporting position so as to support said pail vertically, said lug extends radially through said notch and said notch prevents forced relative motion between said lid and said pail, wherein, said at least one notch comprises four substantially equally circumferentially spaced notches, and said at least one lug comprises four substantially equally circumferentially spaced lugs protruding from said lid for mating with said notches, and wherein, said notches and said lugs are in the vicinity of the periphery of said base and said lid respectively.

9. A rotationally resistive pail, pail support and coupling, comprising:

a hollow pail having an opening and a base;

said pail having a lid engaging means in said base of said pail; and, a mating lid for said pail, separate from said pail for disengageable closure of said pail opening, and for removal from said disengageable closure of said pail opening and placement so as to be releasably engageable with said pail base for supporting and lockingly engaging said pail in a supporting position;

said lid having a pail engaging means for vertical interlocking and rotationally preventative engagement with said lid engaging means when said lid is in said supporting position, wherein, when said lid is in said supporting position, said lid supports said pail vertically, and said engaging means prevents forced relative rotation between said lid and said pail said lid engaging means comprises at least one opposed lug and said pail engaging means has at least one notch corresponding to said lug wherein said lug comprises a substantially trapezoidal element, and said notch has a corresponding shape when viewed in a direction radial to said lid and said pail, for vertical interlocking engagement with said element, and wherein said substantially trapezoidal element has a top and bottom, and said top is at least as wide as said bottom when viewed from a direction radial to said lid and said pail.

10. The device of claim 9 wherein said lug extends radially through said notch.

* * * * *